US005767664A

United States Patent [19]

Price

[11] Patent Number: 5,767,664

[45] Date of Patent: Jun. 16, 1998

[54] BANDGAP VOLTAGE REFERENCE BASED TEMPERATURE COMPENSATION CIRCUIT

[75] Inventor: Burt L. Price, Apex, N.C.

[73] Assignee: Unitrode Corporation, Merrimack, N.H.

[21] Appl. No.: 739,627

[22] Filed: Oct. 29, 1996

[51] Int. Cl.[6] ..... G05F 3/30; G05F 3/04; G05F 1/567

[52] U.S. Cl. ..... 323/907; 323/313; 327/103; 327/306

[58] Field of Search ..... 323/907, 313, 323/314, 315, 316; 327/103, 306

[56] References Cited

U.S. PATENT DOCUMENTS

| | | | |
|---|---|---|---|
| 3,887,863 | 6/1975 | Brokaw | 323/19 |
| 4,250,445 | 2/1981 | Brokaw | 323/313 |
| 4,270,118 | 5/1981 | Brokaw | 307/361 |
| 4,475,169 | 10/1984 | Gilbert | 364/817 |
| 4,603,291 | 7/1986 | Nelson | 323/315 |
| 4,622,512 | 11/1986 | Brokaw | 323/313 |
| 4,808,908 | 2/1989 | Lewis et al. | 323/313 |
| 4,857,823 | 8/1989 | Bitting | 323/314 |
| 5,053,640 | 10/1991 | Yum | 307/296.6 |
| 5,130,577 | 7/1992 | Neidorff et al. | 307/490 |
| 5,291,122 | 3/1994 | Audy | 323/313 |
| 5,352,973 | 10/1994 | Audy | 323/313 |
| 5,489,878 | 2/1996 | Gilbert | 331/57 |
| 5,519,308 | 5/1996 | Gilbert | 323/313 |

*Primary Examiner*—Peter S. Wong
*Assistant Examiner*—Rajnikant B. Patel
*Attorney, Agent, or Firm*—Weingarten, Schurgin, Gagnebin & Hayes LLP

[57] ABSTRACT

A voltage-to-current converter for use with a bandgap voltage reference circuit for providing a correction current to compensate for the adverse effects of temperature. In one specific embodiment, the voltage-to-current converter is used to provide output voltage curvature correction to the resident bandgap voltage reference circuit.

17 Claims, 6 Drawing Sheets

BANDGAP VOLTAGE REFERENCE BASED TEMPERATURE COMPENSATION CIRCUIT

FIELD OF INVENTION

The present invention relates generally to voltage reference circuits and, more particularly, to a bandgap voltage reference based temperature compensation circuit.

BACKGROUND OF THE INVENTION

Nearly all electronic circuits require one or more sources of stable DC voltage. To fulfill this requirement, a wide variety of DC reference voltage supplies have been designed. Some of these DC reference voltage supplies utilize temperature compensated zener diodes to provide stability. However, zener diodes have relatively high breakdown voltages, which prohibits their use in low voltage supplies. Furthermore, zener diodes are inherently noisy devices and they suffer from long term stability problems.

As an alternative to the use of zener diodes in DC reference voltage supplies, circuits known as bandgap voltage references have become widely used. In a bandgap voltage reference circuit, the bandgap voltage of silicon is utilized as an internal reference to provide a regulated output voltage. This approach overcomes many of the limitations of zener diode based voltage references such as long term stability errors and the inability to provide a low output voltage. An embodiment of a bandgap voltage reference circuit is disclosed in U.S. Pat. No. 3,887,863 (hereinafter referred to as the '863 patent), which issued Jun. 3, 1975 to A. P. Brokaw. The bandgap voltage reference circuit disclosed in the '863 patent relies upon a bandgap cell, commonly referred to as a "Brokaw cell" based upon the name of the inventor. The teachings of the '863 patent are hereby incorporated by reference.

Referring to FIG. 1, a schematic representation of a standard Brokaw cell 10 is shown. The Brokaw cell 10 comprises a pair of transistors, Q1 and Q2, and a pair of resistors, R1 and R2. The area of the emitters in Q1 and Q2 are indicated by A and unity, respectively, wherein A>1. Referring to FIG. 2, a schematic representation of a bandgap voltage reference circuit 12 is shown incorporating a Brokaw cell 10. In addition to the Brokaw cell 10, the bandgap voltage reference circuit 12 comprises an operational transresistance amplifier R and a pair of resistors, R3 and R4, which allow the reference output voltage, $V_{OUT}$, to exceed the bandgap voltage.

In operation, Q1 and Q2 are operated at different current densities and a voltage, which is proportional to the difference in the base-emitter voltages of Q1 and Q2 (termed $\Delta V_{BE}$), is developed across R1. Referring to FIG. 3, a graph is provided displaying the characteristics of the collector currents, $I_{C1}$ and $I_{C2}$, versus the base voltage, $V_B$, of Q1 and Q2. The operation of the negative feedback loop in the bandgap voltage reference circuit 12 seeks to make $I_{C1}=I_{C2}$. Therefore, $V_B$ is driven to the "cross-over" point $V_{CROSS}$ in FIG. 3. With $I_{C1}=I_{C2}$, the loop equation $$I_{C1}R1 + V_T\ln\frac{I_{C1}}{AI_S} - V_T\ln\frac{I_{C2}}{I_S} = 0$$

reduces to $$I_{C1}R1 = V_T\ln A = \frac{kT}{q}\ \ln A$$

wherein $I_S$ is the reverse saturation leakage current. The above equation indicates that the voltage across R1 ($V_{R1}$) is proportional-to-absolute-temperature (PTAT). It follows that the voltage across R2 ($V_{R2}$) is also PTAT.

It is well known that the base-emitter voltage ($V_{BE}$) of a bipolar junction transistor has a negative temperature coefficient generally between −1.7 mV/°C. and −2 mV/°C. It is also well known that the PTAT voltage developed across R2 has a positive temperature coefficient. By matching the temperature coefficient of the $V_{BE}$ of Q2 to the temperature coefficient of $V_{R2}$ of R2, the first order temperature coefficient of $V_B$ can be made equal to zero. The resulting value of $V_B$ at which this is realized is widely called "the magic voltage" and is typically around 1.25 V depending on the processing of the transistors.

The foregoing has all been previously demonstrated in numerous writings including the '863 patent. However, it also well known in the field, and has been demonstrated in various writings, that the temperature behavior of $V_B$ and $V_{OUT}$ in the bandgap voltage reference circuit 12 shows a strong parabolic down characteristic (see Gray and Meyer, *Analysis and Design of Integrated Circuits*, 2nd ed., 1984 John Wiley & Sons, Inc., page 292). Accordingly, it would be desirable to improve the temperature behavior of $V_B$ and $V_{OUT}$ in the bandgap voltage reference circuit 12. More particularly, it would be desirable to develop a bandgap voltage reference circuit that produces a substantially flat output voltage characteristic over a fairly wide temperature range of operation.

BRIEF SUMMARY OF THE INVENTION

In its most basic form, the present invention contemplates a voltage-to-current converter for use with a bandgap voltage reference circuit for providing a correction current to compensate for the adverse effects of temperature. In one specific embodiment, the voltage-to-current converter is used to provide output voltage curvature correction to the resident bandgap voltage reference circuit.

The bandgap voltage reference circuit has an output voltage dividing resistor network in a feedback loop thereof, and the bandgap voltage reference circuit provides a voltage signal that is proportional to absolute temperature. The voltage-to-current converter comprises at least one differential transistor pair, wherein a first transistor in such a pair is responsive to the voltage signal that is proportional to absolute temperature, and wherein a second transistor in such a pair is responsive to a corresponding voltage signal derived from the output voltage dividing resistor network. The voltage-to-current converter also comprises at least one corresponding current source for insuring that there is a constant flow of current to the at least one differential transistor pair for use in providing a temperature compensating correction current. The voltage-to-current converter further comprises at least one additional differential transistor pair, wherein a first transistor in such an additional pair is responsive to the voltage signal that is proportional to absolute temperature, and wherein a second transistor in such an additional pair is responsive to a corresponding voltage signal derived from the output voltage dividing resistor network. The voltage-to-current converter additionally comprises at least one corresponding current sink for insuring that there is a constant flow of current from the at least one additional differential transistor pair for use in providing the temperature compensating correction current.

In the voltage-to-current converter, each corresponding voltage signal derived from the output voltage dividing resistor network is chosen to provide a voltage value that is equal to the voltage signal that is proportional to absolute temperature at a specific temperature value.

Accordingly, the primary object of the present invention is to provide a voltage-to-current converter for use with a bandgap voltage reference circuit for providing a correction current to compensate for the adverse effects of temperature.

The above primary object, as well as other objects, features, and advantages, of the present invention will become readily apparent from the following detailed description which is to be read in conjunction with the appended drawings.

BRIEF DESCRIPTION OF THE SEVERAL VIEWS OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE PRESENT INVENTION

Figure 1:
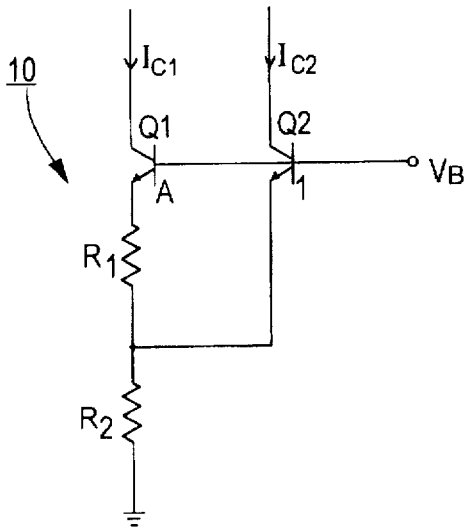
FIG. 1 (PRIOR ART)
FIG. 1 is a schematic representation of a standard Brokaw bandgap cell.

Referring again to FIG. 2, and realizing that $V_{R2}$ is PTAT and that $V_B$ is temperature stable (first-order), and, furthermore, that any voltage "tapped-out" of R4 (i.e. making R4 a voltage divider but with total resistance unchanged) will also be temperature stable, a circuit stage exhibiting multiple transconductance functions can be used in accordance with the present invention to construct arbitrary current functions of temperature. Such a circuit stage 14 is shown in FIG. 4 and includes a plurality of differential MOSFET pairs 16 and a plurality of current sources 18 and current sinks 20.

The current sources 18 and current sinks 20 provide constant current flow and are ideally temperature independent, although it is within the scope of the present invention to compensate for some degree of temperature dependent behavior of the current sources 18 and current sinks 20. The input voltage $V_{R2}$ is provided from the bandgap voltage reference circuit 12 of FIG. 2. Similarly, the input voltages $V_{T1}$ to $V_{Tl}$ are "tapped-out" of R4 in the bandgap voltage reference circuit 12 of FIG. 2. The dashed lines indicate that the drains of the MOSFETs can be connected to either the positive or negative output current rails. The widths/lengths (W/L) of the MOSFETs can be individually tailored to provide a desired $V_{R2}$ to $I_{OUT}$ transfer characteristic.

An output voltage characteristic can be obtained merely by following the circuit stage 14 with a transresistance amplifier. The circuit stage 14 can also be implemented with bipolar junction transistors with emitter degeneration resistors. As described in detail below, the circuit stage 14 need only include as many of the differential pairs 16 as are needed to achieve a voltage-to-current transfer function with the desired degree of accuracy.

Figure 2:
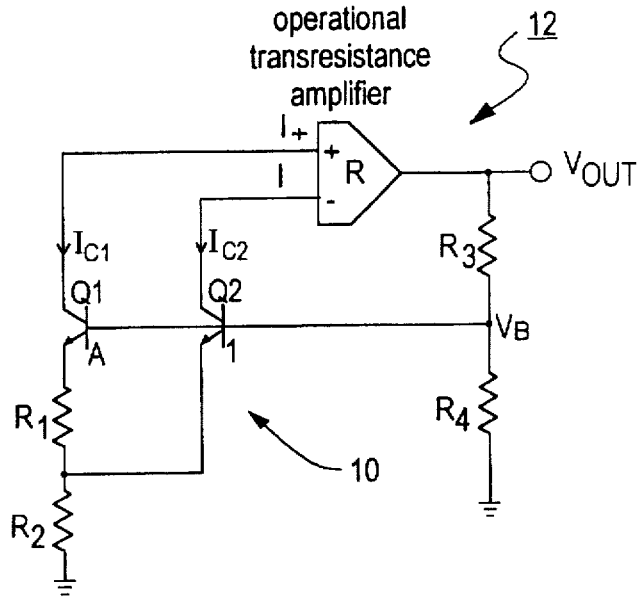
FIG. 2 (PRIOR ART)
FIG. 2 is a schematic representation of a bandgap voltage reference circuit incorporating the Brokaw cell of FIG. 1.
Figure 3:
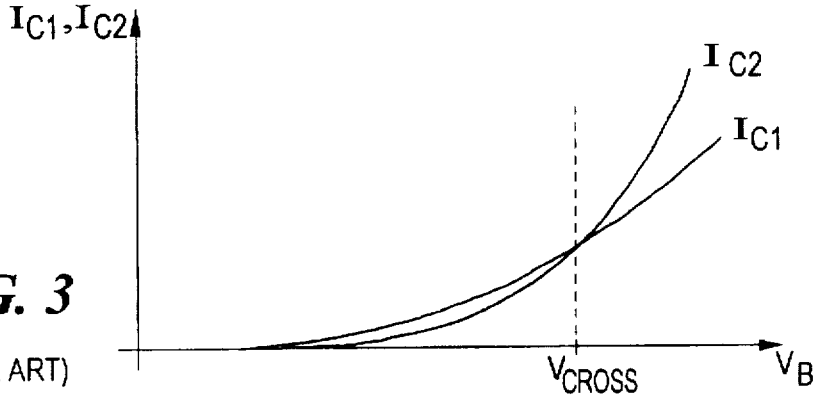
FIG. 3 (PRIOR ART)
FIG. 3 is a graph displaying the characteristics of the collector currents, $I_{C1}$ and $I_{C2}$, versus the base voltage, $V_B$, of Q1 and Q2 in the bandgap voltage reference circuit of FIG. 2.
Figure 4:
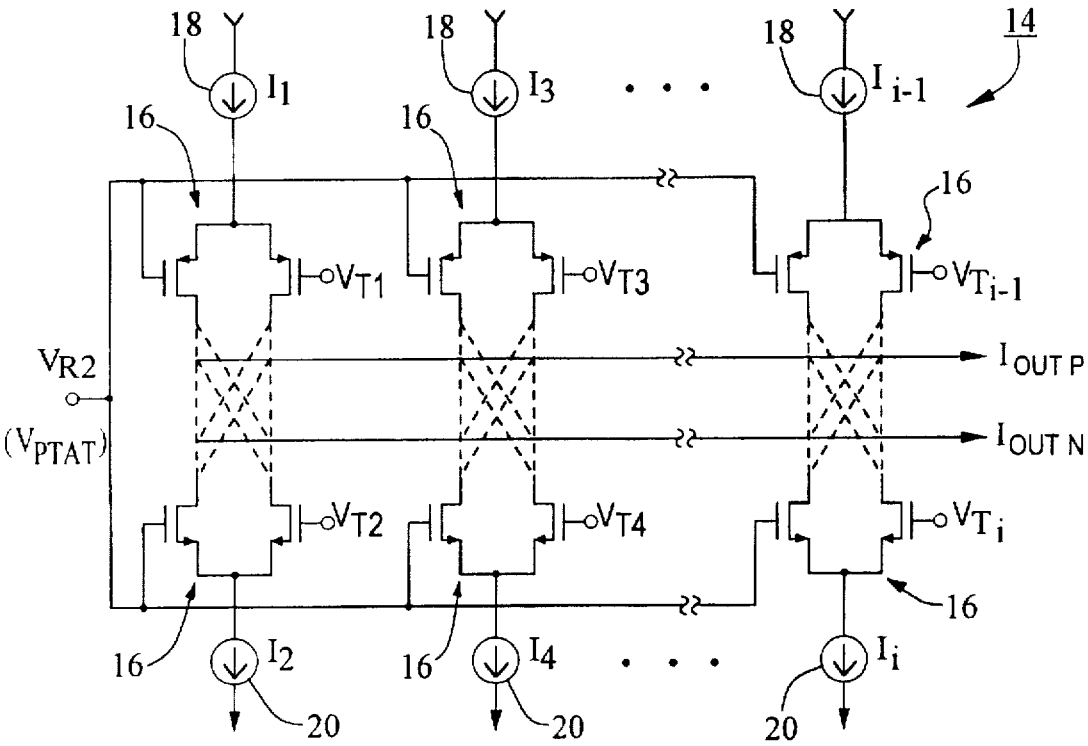
FIG. 4 is a schematic representation of a circuit stage which exhibits multiple transconductance functions for use in constructing arbitrary current functions of temperature.
Figure 5:
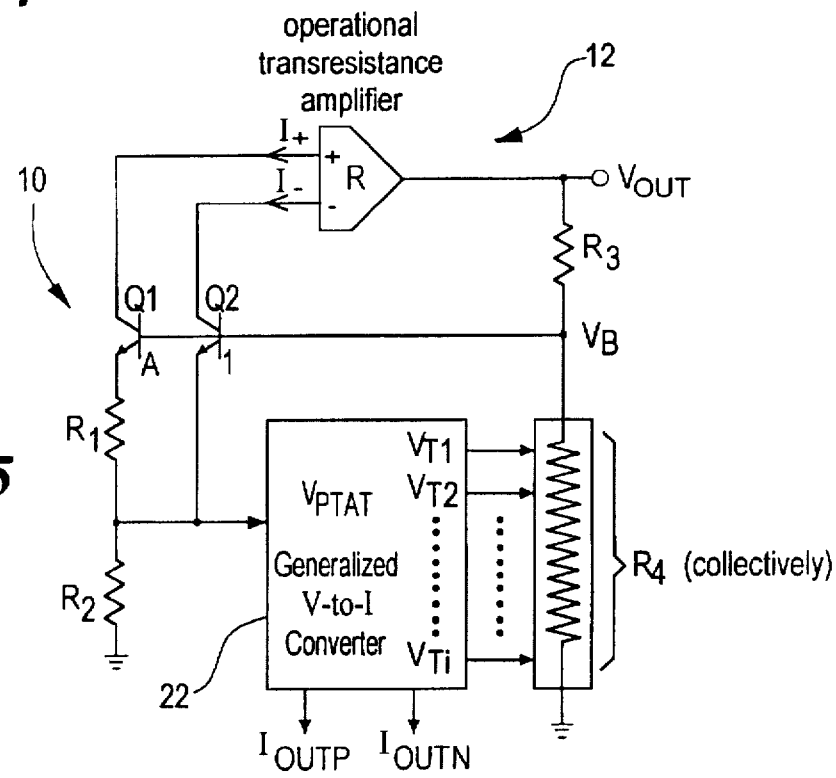
FIG. 5 is a schematic representation of a bandgap voltage reference circuit utilizing a generalized voltage-to-current (V to I) converter according to the present invention.

Referring to FIG. 5, a generalized voltage-to-current (V to I) converter circuit 22, based upon circuit stage 14 of FIG. 4, has been added to the bandgap voltage reference circuit 12 of FIG. 2 so as to provide curvature correction to the output voltage ($V_{OUT}$) over temperature. The multiple transconductance functions of the generalized V to I converter circuit 22 are used in accordance with the present invention to construct arbitrary current functions of temperature for the bandgap voltage reference circuit 12.

Numerous design possibilities exist for the generalized V to I converter circuit 22. This is particularly the case in determining the number of the differential pairs, or differential pair segments, that are to be used in the generalized V-to-I converter circuit 22. For simplicity of explanation, a V-to-I converter circuit using only two differential pair segments will be described herein. Such a V-to-I converter circuit 24 is shown in FIG. 6.

Figure 6:
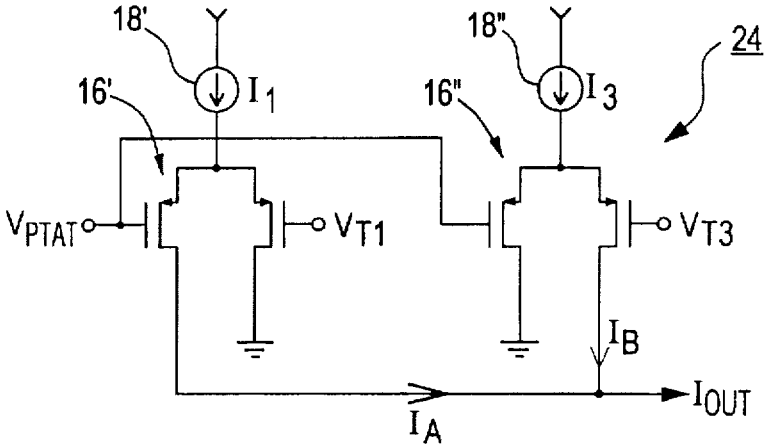
FIG. 6 is a schematic representation of a V-to-I converter using only two differential pair segments according to the present invention.
Figure 7:
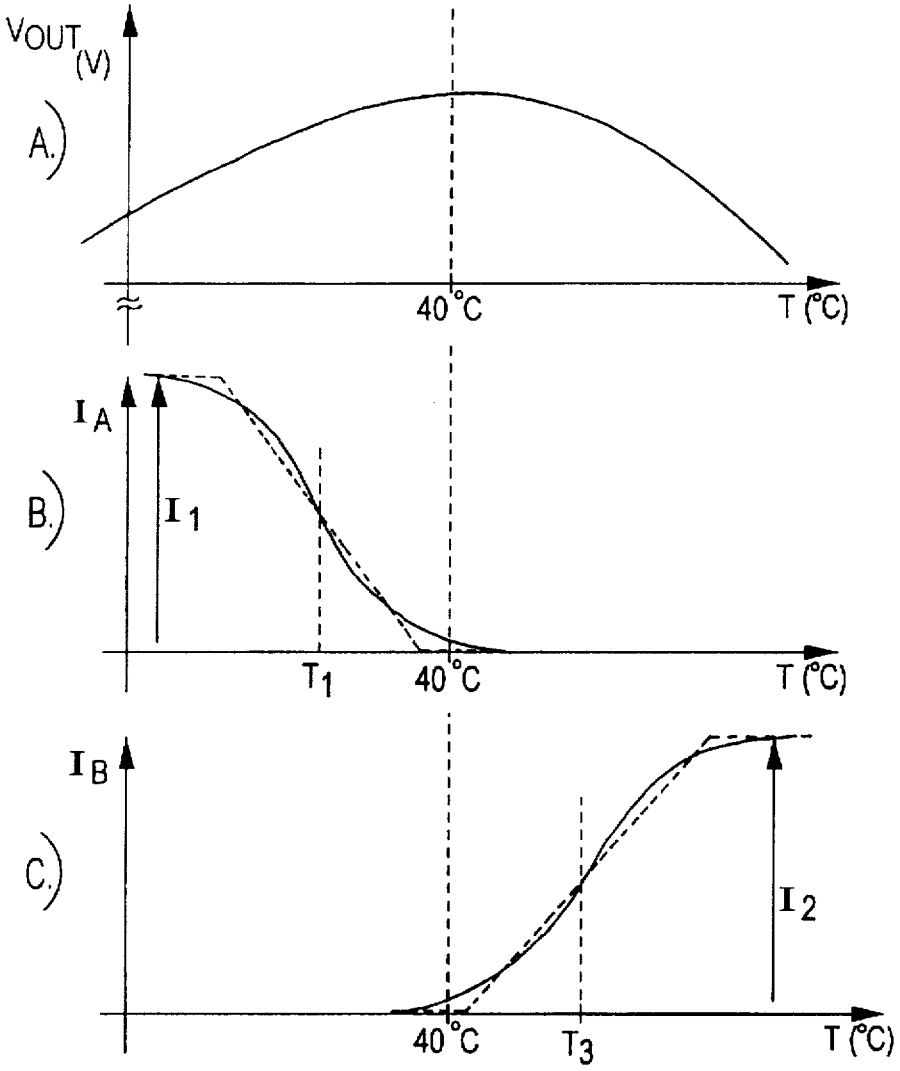
FIG. 7A is a graph showing the output voltage characteristics over temperature of a typical uncompensated, or uncorrected, bandgap voltage reference circuit.
FIG. 7B is a graph showing the current characteristics of $I_A$ in the V-to-I converter circuit of FIG. 6.
FIG. 7C is a graph showing the current characteristics of $I_B$ in the V-to-I converter circuit of FIG. 6.

Referring to FIG. 7A, a graph is provided indicating the output voltage characteristics over temperature of a bandgap voltage reference circuit incorporating a Brokaw cell, such as the circuit 12 shown in FIG. 2. The graph of FIG. 7A shows that the output voltage characteristics over temperature of the bandgap voltage reference circuit are parabolic, in this particular case, about a center temperature value of 40° C. The graph of FIG. 7A shows the output voltage characteristics of a typical uncompensated, or uncorrected, bandgap voltage reference circuit. The curvature correcting nature of the V-to-I converter circuit 24 shown in FIG. 6 operates to deflate the natural parabolic shape of the output voltage characteristics of such typical uncorrected bandgap voltage reference circuits over temperature. The V-to-I converter circuit 24 operates by having the first differential pair 16' flatten the $V_{OUT}$ curve below 40° C. and the second differential pair 16" flatten the $V_{OUT}$ curve above 40° C. The W/L ratios of the differential pairs 16 are chosen to achieve wide temperature ranges wherein the flattening is effective.

Referring to FIGS. 7B and 7C, these graphs provide an indication of the current characteristics of $I_A$ and $I_B$ in the V-to-I converter circuit 24 of FIG. 6. Linear approximations of $I_A$ and $I_B$ are also shown as dashed lines. Curvature correction by the V-to-I converter circuit 24 shown in FIG. 6 is fashioned by summing $I_A$ and $I_B$ into $I_{OUT}$, changing the direction of $I_{OUT}$ with a current mirror, and then extracting a correction current from the $V_B$ node of FIG. 5. Proper scaling of the current sources $I_1$ and $I_3$ is of course necessary as described in detail below. These current sources 18 can either be derived from the collector currents of the Brokaw cell 10 or through some other means. Whatever their derivation, their temperature behavior and resulting impact on the correction voltage developed across R3 of FIG. 5 can be accounted for in the design of the differential pairs 16.

Figure 8:
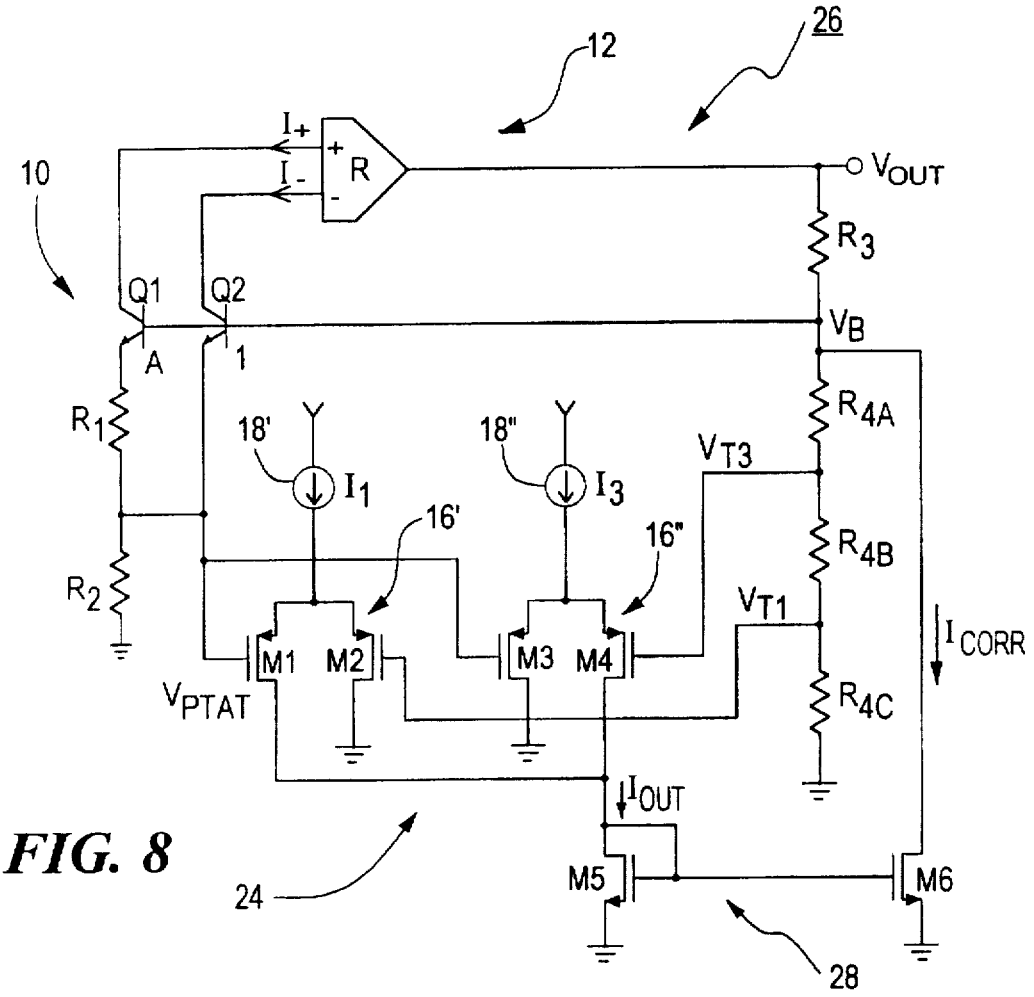
FIG. 8 is a schematic representation of a bandgap voltage reference curvature correction circuit having a V-to-I converter circuit with two differential pair segments according to the present invention.
Figure 9:
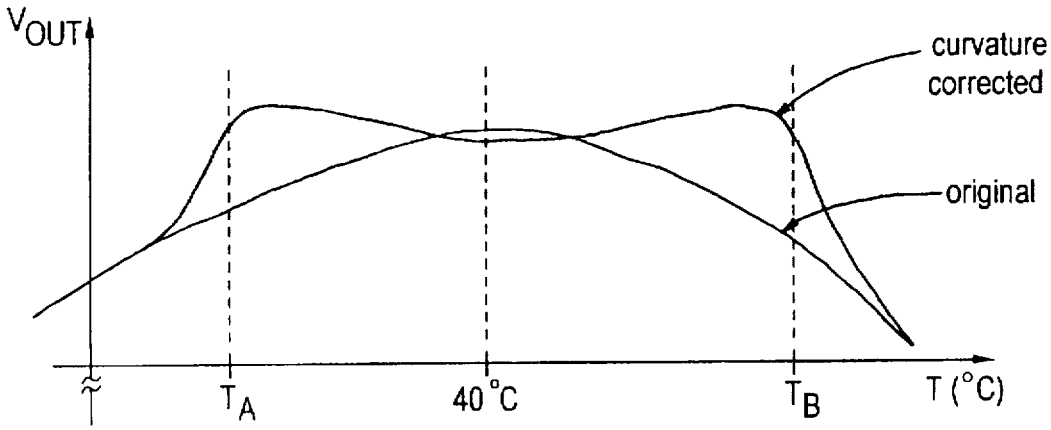
FIG. 9 is a graph showing the output voltage characteristics over temperature of the bandgap voltage reference curvature correction circuit of FIG. 8 in comparison to the output voltage characteristics of a typical uncompensated, or uncorrected, bandgap voltage reference circuit.

Referring to FIG. 8, a complete bandgap voltage reference curvature correction circuit 26 is shown utilizing the V-to-I converter circuit 24 with two differential pair segments 16 made up of MOSFETs M1–M4. A current mirror 28 is formed with MOSFETs M5 and M6 so as to extract a correction current, $I_{CORR}$, from the $V_B$ node. FIG. 9 shows the effect that the V-to-I converter circuit 24 has on the output voltage $V_{OUT}$ over temperature in comparison to the output voltage characteristics of a typical uncompensated, or uncorrected, bandgap voltage reference circuit, such as are shown in FIG. 7A.

The bandgap voltage reference curvature correction circuit 26 allows several degrees of freedom for the purpose of achieving the desired amount of curvature correction. For instance, the magnitudes of the current sources $I_1$ and $I_3$, the current mirroring gain between M5 and M6, and the location where the drain of M6 connects into the output voltage divider are all areas where the circuit 26 may be adjusted in order to achieve the desired amount of curvature correction. It should be noted, however, that extra care must be used if the drain of M6 is connected into the R4 divider string.

The W/L ratios of M1–M4 are chosen to maximize the flattened area of the output voltage characteristics shown in FIG. 9 from $T_A$ to $T_B$. $T_A$ and $T_B$ represent the boundaries of the dynamic range wherein the V-to-I converter circuit 24 is effective in providing curvature correction. The tap point in the R4 divider string which provides $V_{T1}$ is chosen to give a voltage equal to $V_{PTAT}$ at $T_1$° C. (see FIG. 7B). Similarly, the tap point in the R4 divider string which provides $V_{T3}$ is chosen to give a voltage equal to $V_{PTAT}$ at $T_3$° C. (see FIG. 7C).

If the desired results cannot be obtained with just the two differential pair segments 16' and 16", it is a simple matter to add more. It should be noted, however, that a V-to-I converter circuit having a single differential pair 16 could also be used to compensate for the effects of temperature on an uncompensated bandgap voltage reference circuit if the parabolic peak in the output voltage characteristics of the uncompensated bandgap voltage reference circuit is purposely offset above or below the center temperature value of 40° C. so that the monotonically increasing or decreasing current functions of the V-to-I converter circuit could be used to flatten the output voltage characteristics curve in the respective temperature regions.

Figure 10:
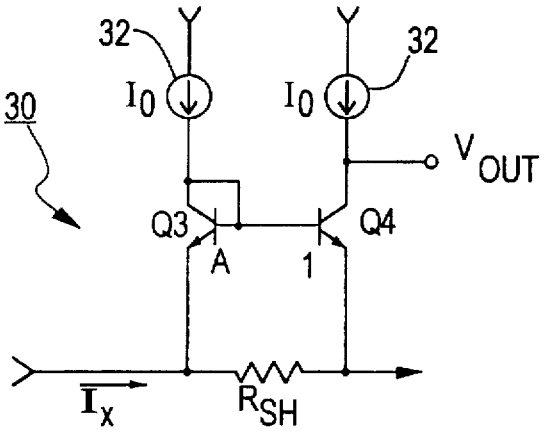
FIG. 10 is a schematic representation of a ΔVBE comparator circuit.

The generalized V-to-I converter circuit 22 can also be used in conjunction with the bandgap voltage reference circuit 12 to provide temperature compensation to a ΔVBE comparator. A ΔVBE comparator circuit 30 is shown in FIG. 10 and comprises a pair of current sources 32, a pair of transistors, Q3 and Q4, and a shunt resistor, $R_{SH}$. The area of the emitters in Q3 and Q4 are indicated by A and unity, respectively, wherein A>1. The current sources 32 would typically be implemented with PMOS FET's in a BiCMOS process, or they could be made with lateral PNP's. This topology often finds common usage in over-current sensors.

The threshold voltage of the ΔVBE comparator can be shown to be equal to $$V_{TH}=V_T \ln A$$

wherein $V_T$=kT/q and is known as the thermal voltage. The threshold current of the ΔVBE comparator can correspondingly be shown to be equal to $$I_{TH}=\frac{V_T \ln A}{R_{SH}}$$

A serious drawback to the ΔVBE comparator circuit 30 is that if $R_{SH}$ has a small temperature coefficient, then $I_{TH}$ will have an extremely large temperature coefficient. This large temperature coefficient can be dealt with using the bandgap voltage reference circuit 12 and the generalized V to I converter circuit 22 of FIG. 5.

Figure 11:
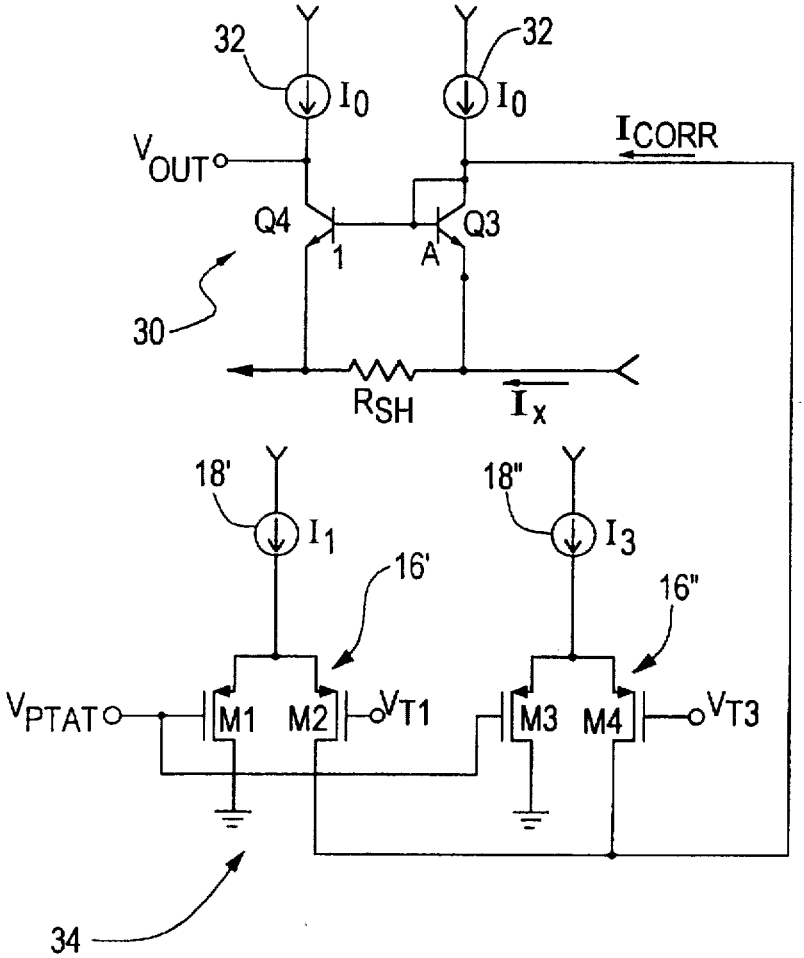
FIG. 11 is a schematic representation of the ΔVBE comparator circuit shown in FIG. 10 along with a V-to-I converter circuit for providing a correction current thereto.

Referring to FIG. 11, the ΔVBE comparator circuit 30 is shown having a correction current being provided thereto by a V-to-I converter circuit 34 that is configured in a different manner than the V-to-I converter circuit 24 shown in FIGS. 6 and 8. The V-to-I converter circuit 34 has two differential pair segments, but the correction current, $I_{CORR}$, is being produced by MOSFETs M2 and M4. Although not shown in FIG. 11, the bandgap voltage reference circuit 12 is used to provide the $V_{PTAT}$, $V_{T1}$, and $V_{T3}$ input voltages to the V-to-I converter circuit 34.

Figure 12:
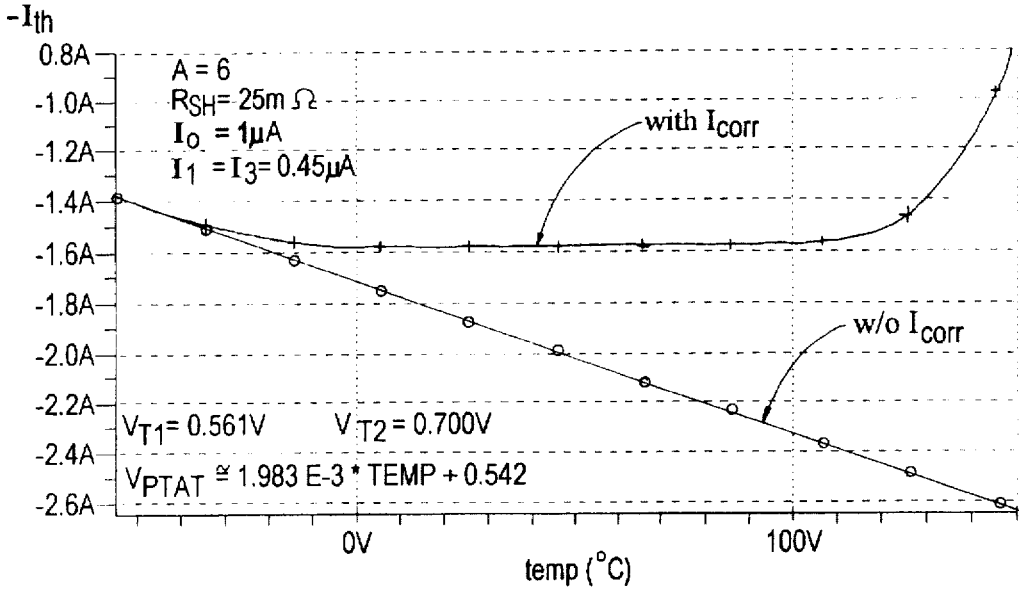
FIG. 12 is a graph showing the threshold current as a function of temperature of the ΔVBE comparator circuit shown in FIGS. 10 and 11 for the uncorrected and corrected cases, respectively.
Figure 13:
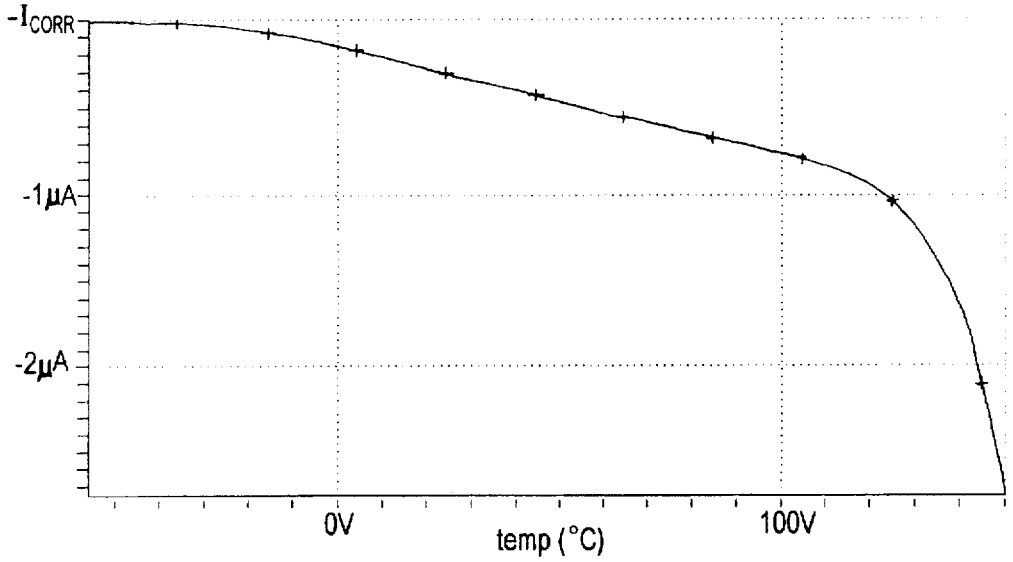
FIG. 13 is a graph showing the correction current provided by the V-to-I converter circuit shown in FIG. 11 over temperature.

FIG. 12 shows the threshold current value of $I_x$ where the ΔVBE comparator circuit 30 trips as a function of temperature for both the corrected and uncorrected cases. Note the extremely flat region from 0° C. to 100° C. for the corrected case. The temperature coefficient from 0° C. to 100° C. is about 145 ppm/°C. for the corrected case and about 3000 ppm/°C. for the uncorrected case. FIG. 13 is a plot of the correction current, $I_{CORR}$, versus temperature.

The V-to-I converter circuit 34 of FIG. 11 provides a first order correction current to the ΔVBE comparator circuit 30. In contrast, the V-to-I converter circuit 24 of FIG. 8 provides a second order correction current to the bandgap voltage reference circuit 12.

The correction currents generated by the generalized V to I converter circuit 22 of FIG. 5 can be put to a wide variety of uses, basically wherever a synthesized function of temperature is needed. One more such application would be in a transconductance amplifier whose gain needs to be tailored over temperature.

The present invention is not to be limited in scope by the specific embodiments described herein. Indeed, various modifications of the present invention, in addition to those described herein, will be apparent to those of skill in the art from the foregoing description and accompanying drawings. Thus, such modifications are intended to fall within the scope of the appended claims. Additionally, various references are cited throughout the specification, the disclosures of which are each incorporated herein by reference in their entirety.

What is claimed is:

1. A corrector circuit for providing a correction current to compensate for the adverse effects of temperature, said corrector circuit comprising:

a bandgap voltage reference circuit, said bandgap voltage reference circuit having an output voltage dividing resistor network in a feedback loop thereof, said bandgap voltage reference circuit providing a voltage signal that is proportional to absolute temperature;

at least one differential transistor pair, wherein a first transistor in said pair is responsive to said voltage signal that is proportional to absolute temperature, and wherein a second transistor in said pair is responsive to a corresponding voltage signal derived from said output voltage dividing resistor network; and at least one corresponding current source for insuring that there is a constant flow of current to said at least one differential transistor pair for use in providing a temperature compensating correction current.

2. The corrector circuit as defined in claim 1, further comprising:

at least one additional differential transistor pair, wherein a first transistor in said additional pair is responsive to said voltage signal that is proportional to absolute temperature, and wherein a second transistor in said additional pair is responsive to a corresponding voltage signal derived from said output voltage dividing resistor network; and at least one corresponding current sink for insuring that there is a constant flow of current from said at least one additional differential transistor pair for use in providing said temperature compensating correction current.

3. The corrector circuit as defined in claim 2, wherein each corresponding voltage signal derived from said output voltage dividing resistor network is chosen to provide a voltage value that is equal to said voltage signal that is proportional to absolute temperature at a specific temperature value.

4. A corrector circuit for providing a correction current to compensate for the adverse effects of temperature, said corrector circuit comprising:

a bandgap voltage reference circuit, said bandgap voltage reference circuit having an output voltage dividing resistor network in a feedback loop thereof, said bandgap voltage reference circuit providing a voltage signal that is proportional to absolute temperature;

at least one differential transistor pair, wherein a first transistor in said pair is responsive to said voltage signal that is proportional to absolute temperature, and wherein a second transistor in said pair is responsive to a corresponding voltage signal derived from said output voltage dividing resistor network; and at least one corresponding current sink for insuring that there is a constant flow of current from said at least one differential transistor pair for use in providing a temperature compensating correction current.

5. The corrector circuit as defined in claim 4, further comprising:

at least one additional differential transistor pair, wherein a first transistor in said additional pair is responsive to said voltage signal that is proportional to absolute temperature, and wherein a second transistor in said additional pair is responsive to a corresponding voltage signal derived from said output voltage dividing resistor network; and at least one corresponding current source for insuring that there is a constant flow of current to said at least one additional differential transistor pair for use in providing said temperature compensating correction current.

6. The corrector circuit as defined in claim 5, wherein each corresponding voltage signal derived from said output voltage dividing resistor network is chosen to provide a voltage value that is equal to said voltage signal that is proportional to absolute temperature at a specific temperature value.

7. An improved bandgap voltage reference circuit that provides output voltage curvature correction to compensate for the adverse effects of temperature, wherein said bandgap voltage reference circuit has an output voltage dividing resistor network in a feedback loop thereof, and wherein said bandgap voltage reference circuit provides a voltage signal that is proportional to absolute temperature, the improvement comprising:

at least one differential transistor pair, wherein a first transistor in said pair is responsive to said voltage signal that is proportional to absolute temperature, and wherein a second transistor in said pair is responsive to a corresponding voltage signal derived from said output voltage dividing resistor network; and at least one corresponding current source for insuring that there is a constant flow of current to said at least one differential transistor pair for use in providing a temperature compensating correction current.

8. The improved bandgap voltage reference circuit as defined in claim 7, further comprising current mirroring means connected to said at least one differential transistor pair and said output voltage dividing resistor network for extracting said temperature compensating correction current from said output voltage dividing resistor network.

9. The improved bandgap voltage reference circuit as defined in claim 7, wherein each corresponding voltage signal derived from said output voltage dividing resistor network is chosen to provide a voltage value that is equal to said voltage signal that is proportional to absolute temperature at a specific temperature value.

10. A voltage-to-current converter for use with a bandgap voltage reference circuit for providing a correction current to compensate for the adverse effects of temperature, wherein said bandgap voltage reference circuit has an output voltage dividing resistor network in a feedback loop thereof, and wherein said bandgap voltage reference circuit provides a voltage signal that is proportional to absolute temperature, said voltage-to-current converter comprising:

at least one differential transistor pair, wherein a first transistor in said pair is responsive to said voltage signal that is proportional to absolute temperature, and wherein a second transistor in said pair is responsive to a corresponding voltage signal derived from said output voltage dividing resistor network; and at least one corresponding current source for insuring that there is a constant flow of current to said at least one differential transistor pair for use in providing a temperature compensating correction current.

11. The voltage-to-current converter as defined in claim 10, further comprising:

at least one additional differential transistor pair, wherein a first transistor in said additional pair is responsive to said voltage signal that is proportional to absolute temperature, and wherein a second transistor in said additional pair is responsive to a corresponding voltage signal derived from said output voltage dividing resistor network; and at least one corresponding current sink for insuring that there is a constant flow of current from said at least one additional differential transistor pair for use in providing said temperature compensating correction current.

12. The voltage-to-current converter as defined in claim 11, wherein each corresponding voltage signal derived from said output voltage dividing resistor network is chosen to provide a voltage value that is equal to said voltage signal that is proportional to absolute temperature at a specific temperature value.

13. A voltage-to-current converter for use with a bandgap voltage reference circuit for providing a correction current to compensate for the adverse effects of temperature, wherein said bandgap voltage reference circuit has an output voltage dividing resistor network in a feedback loop thereof, and wherein said bandgap voltage reference circuit provides a voltage signal that is proportional to absolute temperature, said voltage-to-current converter comprising:

at least one differential transistor pair, wherein a first transistor in said pair is responsive to said voltage signal that is proportional to absolute temperature, and wherein a second transistor in said pair is responsive to a corresponding voltage signal derived from said output voltage dividing resistor network; and at least one corresponding current sink for insuring that there is a constant flow of current from said at least one differential transistor pair for use in providing a temperature compensating correction current.

14. The voltage-to-current converter as defined in claim 13, further comprising:

at least one additional differential transistor pair, wherein a first transistor in said additional pair is responsive to said voltage signal that is proportional to absolute temperature, and wherein a second transistor in said additional pair is responsive to a corresponding voltage signal derived from said output voltage dividing resistor network; and at least one corresponding current source for insuring that there is a constant flow of current to said at least one additional differential transistor pair for use in providing said temperature compensating correction current.

15. The voltage-to-current converter as defined in claim 14, wherein each corresponding voltage signal derived from said output voltage dividing resistor network is chosen to provide a voltage value that is equal to said voltage signal that is proportional to absolute temperature at a specific temperature value.

16. A voltage-to-current converter for use with a bandgap voltage reference circuit for providing a correction current to compensate for the adverse effects of temperature, wherein said bandgap voltage reference circuit has an output voltage dividing resistor network in a feedback loop thereof, and wherein said bandgap voltage reference circuit provides a voltage signal that is proportional to absolute temperature, said voltage-to-current converter comprising:

at least one first differential transistor pair, wherein a first transistor in said first differential transistor pair is responsive to said voltage signal that is proportional to absolute temperature, and wherein a second transistor in said first differential transistor pair is responsive to a corresponding voltage signal derived from said output voltage dividing resistor network;

at least one corresponding current source for insuring that there is a constant flow of current to said at least one first differential transistor pair for use in providing a temperature compensating correction current;

at least one second differential transistor pair, wherein a first transistor in said second differential transistor pair is responsive to said voltage signal that is proportional to absolute temperature, and wherein a second transistor in said second differential transistor pair is responsive to a corresponding voltage signal derived from said output voltage dividing resistor network; and at least one corresponding current sink for insuring that there is a constant flow of current from said at least one second differential transistor pair for use in providing said temperature compensating correction current.

17. The voltage-to-current converter as defined in claim 16, wherein each corresponding voltage signal derived from said output voltage dividing resistor network is chosen to provide a voltage value that is equal to said voltage signal that is proportional to absolute temperature at a specific temperature value.

* * * * *